US009051794B2

(12) United States Patent
Hall et al.

(10) Patent No.: US 9,051,794 B2
(45) Date of Patent: Jun. 9, 2015

(54) HIGH IMPACT SHEARING ELEMENT

(75) Inventors: David R. Hall, Provo, UT (US); Ronald B. Crockett, Payson, UT (US); John D. Bailey, Spanish Fork, UT (US); Matt Kudla, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 1973 days.

(21) Appl. No.: 11/734,675

(22) Filed: Apr. 12, 2007

(65) Prior Publication Data

US 2008/0250724 A1 Oct. 16, 2008

(51) Int. Cl.

| | |
|---|---|
| ***B24D 3/02*** | (2006.01) |
| ***E21B 10/567*** | (2006.01) |
| ***B24D 99/00*** | (2010.01) |
| ***E21C 35/183*** | (2006.01) |

(52) U.S. Cl.

CPC ..... *E21B 10/567* (2013.01); *B24D 99/005* (2013.01); *E21C 35/183* (2013.01)

(58) Field of Classification Search

None

See application file for complete search history.

(56) References Cited

U.S. PATENT DOCUMENTS

| | | | | |
|---|---|---|---|---|
| 2,004,315 | A | | 6/1935 | Fenn |
| 2,124,438 | A | | 7/1938 | Struk |
| 3,254,392 | A | | 6/1966 | Novkov |
| 3,746,396 | A | | 7/1973 | Radd |
| 3,807,804 | A | | 4/1974 | Kniff |
| 3,830,321 | A | | 8/1974 | McKenry et al. |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels |
| 4,199,035 | A | | 4/1980 | Thompson |
| 4,201,421 | A | | 5/1980 | Den Besten |
| 4,224,380 | A | | 9/1980 | Bovenkerk |
| 4,268,089 | A | | 5/1981 | Spence |
| 4,277,106 | A | | 7/1981 | Sahley |
| 4,333,902 | A | | 6/1982 | Hara |
| 4,333,986 | A | | 6/1982 | Tsuji et al. |
| 4,337,980 | A | | 7/1982 | Krekeler |
| 4,412,980 | A | | 11/1983 | Tsuji et al. |
| 4,439,250 | A | | 3/1984 | Acharya |
| 4,465,221 | A | | 8/1984 | Schmidt |
| 4,481,016 | A | * | 11/1984 | Campbell et al. ..... 51/295 |
| 4,484,644 | A | | 11/1984 | Cook et al. |
| 4,484,783 | A | | 11/1984 | Emmerich |
| 4,489,986 | A | | 12/1984 | Dziak |

(Continued)

FOREIGN PATENT DOCUMENTS

| | | |
|---|---|---|
| DE | 3307910 | 9/1984 |
| DE | 3500261 | 7/1986 |

(Continued)

*Primary Examiner* — Melvin C Mayes
*Assistant Examiner* — Stefanie Cohen
(74) *Attorney, Agent, or Firm* — Osha Liang LLP

(57) ABSTRACT

A high impact resistant tool having a sintered body of diamond or diamond-like particles in a metal matrix bonded to a cemented metal carbide substrate at a non-planar interface, interface having at least two circumferentially adjacent faces, outwardly angled from a central axis of the substrate. The sintered body has a thickness of 0.100 to 0.500 inches proximate each face. The sintered body also has a flat working surface, wherein the tool has an angle of 30 to 60 degrees between the flat working surface and each face.

20 Claims, 6 Drawing Sheets

(56) References Cited

U.S. PATENT DOCUMENTS

| | | | | |
|---|---|---|---|---|
| 4,604,106 | A | 8/1986 | Hall et al. | |
| 4,647,111 | A | 3/1987 | Bronder et al. | |
| 4,678,237 | A | 7/1987 | Collin | |
| 4,682,987 | A | 7/1987 | Brady | |
| 4,684,176 | A | 8/1987 | Den Besten | |
| 4,688,856 | A | 8/1987 | Elfgen | |
| 4,690,691 | A * | 9/1987 | Komanduri | 51/293 |
| 4,694,918 | A | 9/1987 | Hall | |
| 4,725,098 | A | 2/1988 | Beach | |
| 4,726,718 | A | 2/1988 | Meskin | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,880,154 | A | 11/1989 | Tank | |
| 4,932,723 | A | 6/1990 | Mills | |
| 4,940,099 | A | 7/1990 | Deane et al. | |
| 4,940,288 | A | 7/1990 | Stiffler | |
| 4,944,559 | A | 7/1990 | Sionnet | |
| 4,944,772 | A | 7/1990 | Cho | |
| 4,951,762 | A | 8/1990 | Lundell | |
| 4,956,238 | A | 9/1990 | Griffin | |
| 5,007,685 | A | 4/1991 | Beach | |
| 5,011,515 | A | 4/1991 | Frushour | |
| 5,088,797 | A | 2/1992 | O'Neill | |
| 5,112,165 | A | 5/1992 | Hedlund | |
| 5,141,289 | A | 8/1992 | Stiffler | |
| 5,154,245 | A | 10/1992 | Waldenstrom | |
| 5,186,892 | A | 2/1993 | Pope | |
| 5,251,964 | A | 10/1993 | Ojanen | |
| 5,261,499 | A | 11/1993 | Grubb | |
| D342,268 | S | 12/1993 | Meyer | |
| 5,303,984 | A | 4/1994 | Ojanen | |
| 5,332,348 | A | 7/1994 | Lemelson | |
| 5,351,770 | A * | 10/1994 | Cawthorne et al. | 175/374 |
| 5,417,475 | A | 5/1995 | Graham et al. | |
| 5,447,208 | A | 9/1995 | Lund | |
| 5,535,839 | A * | 7/1996 | Brady | 175/427 |
| 5,542,993 | A | 8/1996 | Rabinkin | |
| 5,653,300 | A | 8/1997 | Lund | |
| 5,720,528 | A | 2/1998 | Ritchey | |
| 5,738,698 | A | 4/1998 | Kapoor | |
| 5,823,632 | A | 10/1998 | Burkett | |
| 5,837,071 | A | 11/1998 | Andersson | |
| 5,845,547 | A | 12/1998 | Sollami | |
| 5,848,657 | A | 12/1998 | Flood | |
| 5,875,862 | A | 3/1999 | Jurewicz | |
| 5,884,979 | A | 3/1999 | Latham | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,003,623 | A | 12/1999 | Miess | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,068,913 | A | 5/2000 | Cho et al. | |
| 6,113,195 | A | 9/2000 | Mercier et al. | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,220,375 | B1 | 4/2001 | Butcher et al. | |
| 6,220,376 | B1 | 4/2001 | Lundell | |
| 6,257,673 | B1 | 7/2001 | Markham et al. | |
| 6,270,165 | B1 | 8/2001 | Peay | |
| 6,290,008 | B1 * | 9/2001 | Portwood et al. | 175/426 |
| 6,302,224 | B1 * | 10/2001 | Sherwood, Jr. | 175/397 |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,481,803 | B2 | 11/2002 | Ritchey | |
| 6,499,547 | B2 | 12/2002 | Scott | |
| 6,508,318 | B1 | 1/2003 | Linden | |
| 6,517,902 | B2 | 2/2003 | Drake | |
| 6,562,462 | B2 | 5/2003 | Griffin | |
| 6,585,326 | B2 | 7/2003 | Sollami | |
| 6,592,985 | B2 | 7/2003 | Griffin | |
| 6,596,225 | B1 | 7/2003 | Pope | |
| 6,601,662 | B2 | 8/2003 | Mattias | |
| 6,672,406 | B2 | 1/2004 | Beuershausen | |
| 6,685,273 | B1 | 2/2004 | Sollami | |
| 6,702,393 | B2 | 3/2004 | Mercier | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki | |
| 6,933,049 | B2 * | 8/2005 | Wan et al. | 428/408 |
| 6,962,395 | B2 | 11/2005 | Mouthaan | |
| 6,966,611 | B1 | 11/2005 | Sollami | |
| 6,994,404 | B1 | 2/2006 | Sollami | |
| 7,204,560 | B2 | 4/2007 | Mercier | |
| D560,699 | S | 1/2008 | Omi | |
| 7,350,601 | B2 | 4/2008 | Belnap | |
| 7,543,662 | B2 | 6/2009 | Belnap | |
| 7,592,077 | B2 | 9/2009 | Gates, Jr. et al. | |
| 7,730,977 | B2 * | 6/2010 | Achilles | 175/434 |
| 2002/0074851 | A1 | 6/2002 | Montgomery | |
| 2002/0153175 | A1 | 10/2002 | Ojanen | |
| 2002/0175555 | A1 | 11/2002 | Mercier | |
| 2003/0141350 | A1 | 7/2003 | Noro | |
| 2003/0209366 | A1 | 11/2003 | McAlvain | |
| 2003/0217869 | A1 | 11/2003 | Snyder et al. | |
| 2003/0234280 | A1 | 12/2003 | Cadden | |
| 2004/0026983 | A1 | 2/2004 | McAlvain | |
| 2004/0155096 | A1 * | 8/2004 | Zimmerman et al. | 228/248.1 |
| 2005/0159840 | A1 | 7/2005 | Lin | |
| 2006/0186724 | A1 | 8/2006 | Stehney | |
| 2006/0237236 | A1 | 10/2006 | Sreshta | |
| 2008/0053710 | A1 * | 3/2008 | Moss | 175/426 |
| 2008/0206576 | A1 | 8/2008 | Qian et al. | |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 12/1988 |
| EP | 0412287 | 7/1990 |
| GB | 2004315 | 3/1979 |
| GB | 2037223 | 7/1980 |
| JP | 5280273 | 10/1993 |

* cited by examiner

HIGH IMPACT SHEARING ELEMENT

BACKGROUND OF THE INVENTION

The invention relates to a high impact resistant tool that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a nonplanar interface and an abrasion resistant layer of super hard material affixed thereto using a high-pressure, high-temperature (HPHT) press apparatus. Such inserts typically include a super hard material layer or layers formed under HPHT conditions. The layers are usually formed in a press apparatus designed to create HPHT conditions and are cemented to a carbide substrate containing a metal binder or catalyst such as cobalt. The carbide substrate is often softer than the super hard material to which it is bonded. Some examples of super hard materials that HPHT presses may produce and sinter include cemented ceramics, polycrystalline diamond, and cubic boron nitride. A cutting element or insert is normally fabricated by placing a carbide substrate into a container or cartridge with a layer of diamond crystals or grains loaded into the cartridge adjacent one face of the carbide substrate. A number of such cartridges are typically loaded into a reaction cell and placed in the HPHT press apparatus. The carbide substrates and adjacent diamond crystal layers are then compressed under HPHT conditions which promotes a sintering of the diamond grains to form a polycrystalline diamond structure. As a result, the diamond grains become mutually bonded to form a diamond layer over the carbide substrate interface. The diamond layer is also bonded to the carbide substrate interface.

Such inserts are often subjected to intense forces, torques, vibration, high temperatures and temperature differentials during operation. As a result, stresses within the structure may begin to form. Drill bits for example may exhibit stresses aggravated by drilling anomalies during well boring operations such as bit whirl or bounce often resulting in spalling, delamination or fracture of the super hard abrasive layer or the substrate thereby reducing or eliminating the cutting elements efficacy and decreasing overall drill bit wear life. The superhard material layer of an insert sometimes delaminates from the carbide substrate after the sintering process as well as during percussive and abrasive use. Damage typically found in percussive and drag bits may be a result of shear failures, although non-shear modes of failure are not uncommon. The interface between the superhard material layer and substrate is particularly susceptible to non-shear failure modes due to inherent residual stresses.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud. The tip is shaped as a cone and is rounded at the tip portion. This rounded portion has a diameter which is 35-60% of the diameter of the insert.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al., which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk, which is herein incorporated by reference for all that it contains, discloses a rotary bit for rock drilling comprising a plurality of cutting elements mounted by inference-fit in recesses in the crown of the drill bit. Each cutting element comprises an elongated pin with a thin layer of polycrystalline diamond bonded to the free end of the pin.

U.S. Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the invention, a high impact resistant tool has a sintered body of diamond or diamond-like particles in a metal matrix bonded to a cemented metal carbide substrate at a nonplanar interface, interface having at least two circumferentially adjacent faces, outwardly angled from a central axis of the substrate. The sintered body has a thickness of 0.100 to 0.500 inches proximate each face. The sintered body also has a flat working surface, wherein the tool has an angle of 30 to 60 degrees between the flat working surface and each face.

The interface may comprise at least 3 circumferentially adjacent faces, outwardly angled from the central axis of the substrate. The interface may also comprise an upper flatted portion coaxial with the central axis of the substrate. A rounded border between the flatted portion and each face may comprise a radius of 0.055 to 0.085 inches. A rounded border between adjacent faces may comprise a radius of 0.060 to 0.140 inches.

The working surface may comprise a region comprising 5 to 0.1 percent metal by volume. The metal may be selected from the group consisting of cobalt, nickel, iron, titanium, tantalum, niobium, tungsten, alloys thereof and combinations thereof. The region may be at least 0.100 inches away from the interface.

The carbide substrate may comprise a metal concentration of 2 to 10 percent metal by volume. The carbide substrate may comprise a volume from 0.010 to 0.500 cubic inches. The faces may be generally concave. The faces may be generally convex. The faces may comprise equal areas. The sintered body may comprise a rim at the working surface. The rim may be chamfered. The rim may be rounded. The sintered body may comprise a metal concentration of less than 4 percent by volume. The sintered body may be monolithic. The tool may be adapted to be used in asphalt picks, drill bits, shear bits, percussion bits, trenchers, coal picks, or combinations thereof.

In another aspect of the invention, a high impact resistant tool in a rotary driving mechanism may comprise a sintered body of diamond or diamond-like particles in a metal matrix bonded to a cemented metal carbide substrate at a nonplanar interface, the interface comprising at least two circumferentially adjacent faces, outwardly angled from a central axis of the substrate. The sintered body may comprise a thickness of 0.100 to 0.500 inches proximate each face. The tool may be inserted into the driving mechanism such that one of the faces forms an angle of 20 to 40 degrees with respect to a formation.

DETAILED DESCRIPTION OF THE INVENTION AND THE PREFERRED EMBODIMENT

Figure 1:
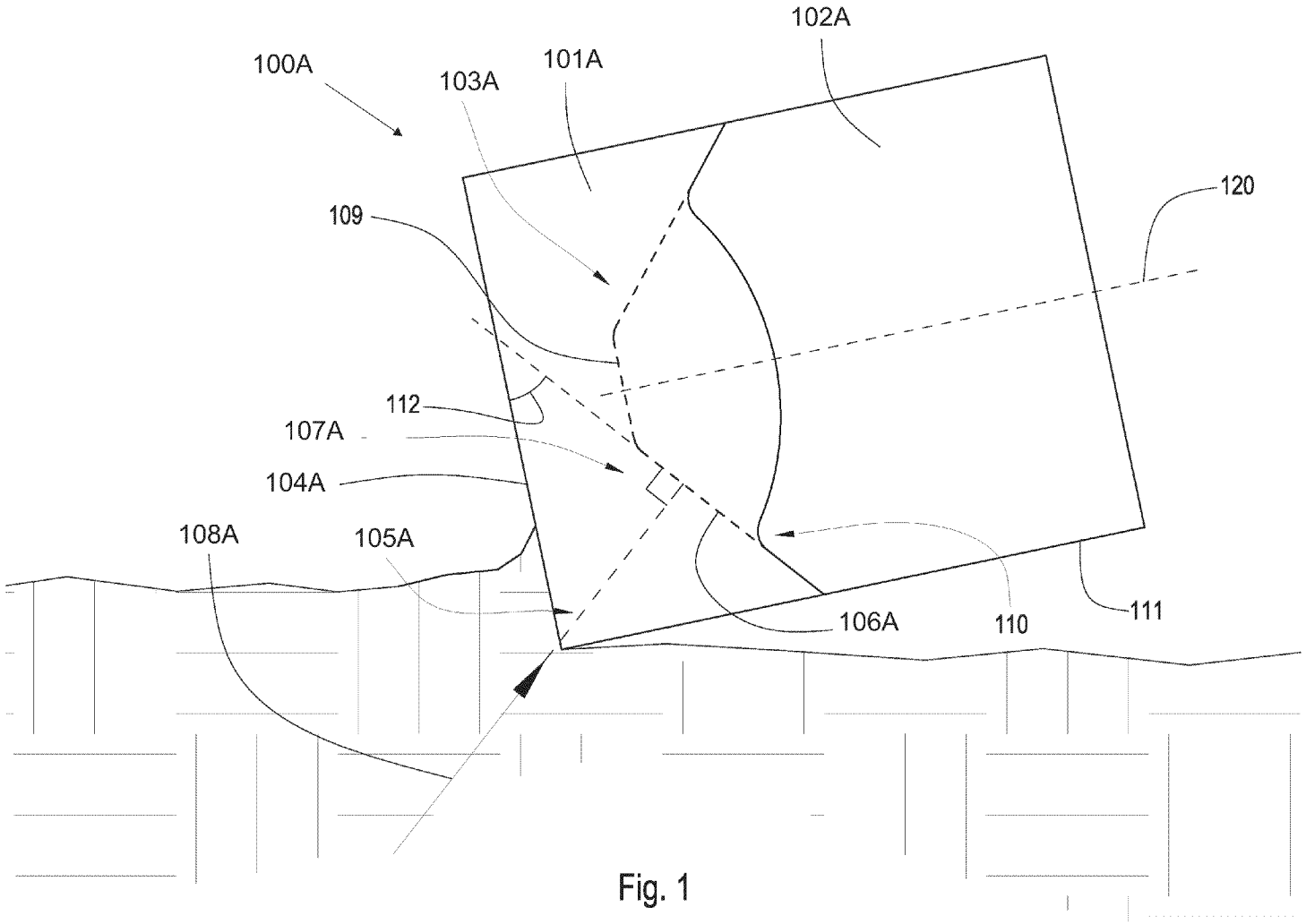
FIG. 1 is a cross-sectional diagram of an embodiment of a high impact resistant tool.

FIG. 1 illustrates an embodiment of a high impact resistant tool 100A which may be used in machines in mining, downhole drilling, asphalt milling, coal mining, or trenching industries. The high impact resistant tool 100A comprises a sintered body 101A of diamond or diamond-like particles in a metal matrix bonded to a cemented metal carbide substrate 102A at a nonplanar interface 103A, a hidden portion of which is shown by the dashed line. The body 101A has a flat working surface 104A used to abrade or degrade road surfaces, rock and earth formations, wood, metal, or other materials.

The amount of metal in the body 101A of the high impact resistant tool 100A may be vital to the working life of the high impact resistant tool 100A, particularly in regions near the working surface 104A. At least one region 105A of the working surface 104A may be far enough away from the nonplanar interface 103A that during high pressure, high temperature (HPHT) processing a restricted amount of metal from the cemented metal carbide substrate 102A reaches the region 105A. The restricted amount of metal is typically 5 to 0.1 percent of the region 105A by volume, resulting in the region 105A having a high density of superhard particles. The region 105A may have the characteristic of being able to withstand an impact of at least 80 joules, and in some embodiments more than 120 joules. Also, due to the low metal concentration in the region 105A, the region 105A may be substantially nonelectrically conductive. The diamond in the sintered body 101A may comprise an average particle size of 5 to 60 microns.

The metal may be distributed throughout the sintered body 101A evenly, though the metal may be distributed progressively, being more highly concentrated near the interface 103A than near the working surface 104A. The concentration of metal in the region 105A may be highly dependent on the thickness of the sintered body 101A. A thicker sintered body 101A may result in a lower concentration of metal in the region near the working surface 104A. At least 99 percent of interstitial voids between diamond particles may be a catalyzing material such as metal.

The cemented metal carbide substrate 102A may have a metal concentration of 2 to 10 percent metal by volume.

The sintered body 101A may have a metal concentration of less than 4 percent by volume. The sintered body 101A may be monolithic. In some embodiments, the sintered body 101A may also have a volume that is 75 percent to 150 percent of the volume of the cemented metal carbide substrate 102A.

A common metal or catalyzing material used in sintering diamond is cobalt, though the metal may be selected from the group consisting of cobalt, nickel, iron, titanium, tantalum, niobium, alloys thereof and combinations thereof. The metal in the body 101A may provide added impact strength to the high impact resistant tool 100A, while a low metal concentration and high diamond density near the working surface 104A may provide better wear resistance to the tool 100A. Thus, the high impact resistant tool 100A may have increased characteristics of both impact strength and wear resistance over tools of the prior art. In other embodiments, other catalysts may be used to sinter the diamond, such as silicon, carbonates hydroxide, hydride, hydrate, phosphorus-oxide, phosphoric acid, carbonate, lanthanide, actinide, phosphate hydrate, hydrogen phosphate, phosphorus carbonate, or combinations thereof.

The high diamond/low catalyst density in the region 105A near the working surface 104A may be achieved by controlling the temperature and time of sintering during HPHT processing. The time of processing may be from 4 to 10 minutes and the temperature may be from 1200 C to 1700 C. A preferable combination of time and temperature during processing may be about 5 minutes at 1400-1500 C.

As the high impact resistant tool 100A degrades an earth formation, an opposing force 108A acts on the working surface 104A of the tool 100A. A face 106A of the interface 103A may be substantially normal to a pre-determined angle 107A of impact derived from the opposing force 108A of the formation. This may allow the opposing force 108A to be spread across the face 106A as the opposing force 108A acts on the tool 100A, which may reduce the stress on the body 101A and the interface 103A. Each face 106A is circumferentially adjacent another face (not shown) and is outwardly angled from a central axis 120A of the carbide substrate 102A. The tool 100A also comprises an angle 112 of 30 to 60 degrees between the flat working surface 104A and the face 106A. The angle 112 may depend on the rake angle of the tool 100A, which may be predetermined when the tool 100A is inserted into a driving mechanism adapted to degrade an earth formation, pavement formation, work piece formation, wood formation, metal formation or combinations thereof. In some aspects of the invention, the tool 100A is inserted into a rotary driving mechanism such that the face 106A forms a general angle of 20 to 40 degrees with respect to the formation.

The high impact resistant tool 100A may have a plurality of faces at the interface 103A, and an upper flatted portion 109A nearest the working face 104A of the body 101A. The flatted portion 109A is normal to the central axis 120A of the cemented metal carbide substrate 102A. The plurality of faces may also create a plurality of ridges, such as ridge 110 along an outer surface 111 of the high impact resistant tool 100A at the interface where the faces meet. Each face of the plurality of faces is bonded to separate sectors of the sintered body 104A which are at least 0.100 inches thick. In some embodiments, the thickest portion of the sectors forms a 75 to 115 angle with the face.

Figure 2:
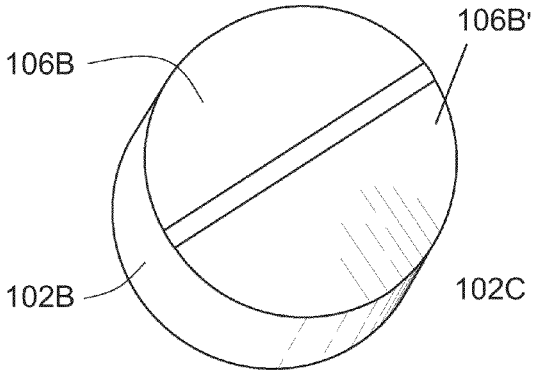
FIG. 2 is perspective diagram of an embodiment of a cemented metal carbide substrate.

As shown in FIGS. 2 though 6, cemented metal carbide substrates 102B, 102C, 102D, 102E, 102F, 102G may have at least two faces. For example, the cemented metal carbide substrate of FIG. 2 includes face 106B and 106B'.

Figure 3:
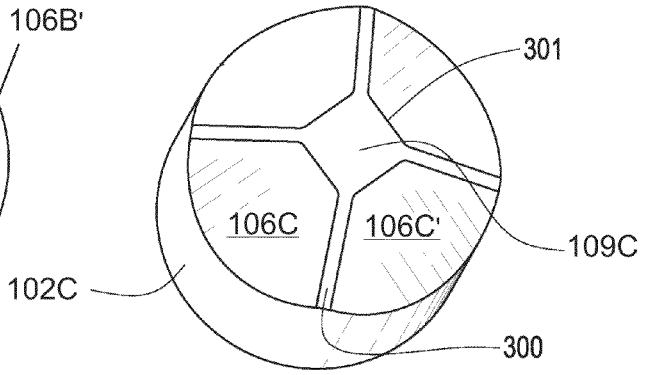
FIG. 3 is a perspective diagram of another embodiment of a cemented metal carbide substrate.

Referring to FIG. 3, a first junction, or rounded border, 300 between adjacent faces, such as face 106C and 106C' may have a radius of curvature of 0.060 to 0.140 inches. A second junction, or second rounded border, 301 between a flatted portion 109C and each face may have a radius of curvature of 0.055 to 0.085 inches.

With reference to FIG. 1, when the region 105A near the working face 104A is worn, the high impact resistant tool 100A may be removed from a driving mechanism, rotated, and re-attached such that another region (not shown) adjacent a face, such as face 106C' is presented to the formation. This may allow for the tool 100A to continue degrading the formation and effectively increase the working life of the tool 100A.

Figure 4:
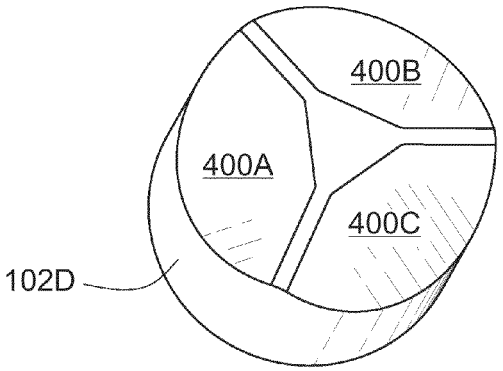
FIG. 4 is a perspective diagram of another embodiment of a cemented metal carbide substrate.

In FIG. 4, an embodiment of a cemented metal carbide substrate 102D has three faces 400A, 400B, and 400C of similar areas.

Figure 5:
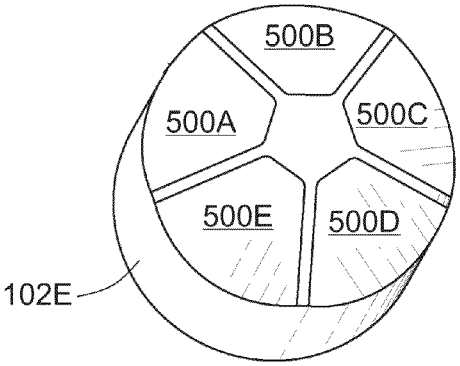
FIG. 5 is a perspective diagram of another embodiment of a cemented metal carbide substrate.

In FIG. 5, an embodiment of a cemented metal carbide substrate 102E has five faces 500A, 500B, 500C, 500D, 500E.

Figure 6:
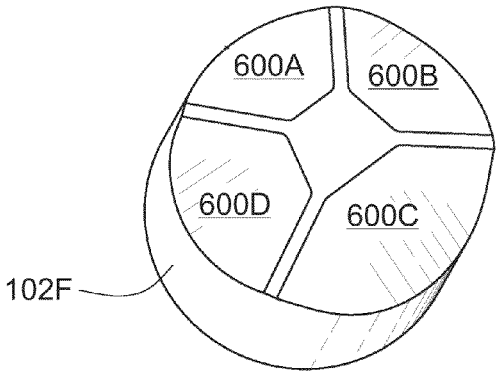
FIG. 6 is a perspective diagram of another embodiment of a cemented metal carbide substrate.

In the embodiment of FIG. 6, cemented metal carbide substrate 102F has four faces 600A, 600B, 600C, 600D. The faces 600A, 600B, 600C, 600 may have equal areas or different areas, with the embodiment of FIG. 6 showing different areas.

Figure 7:
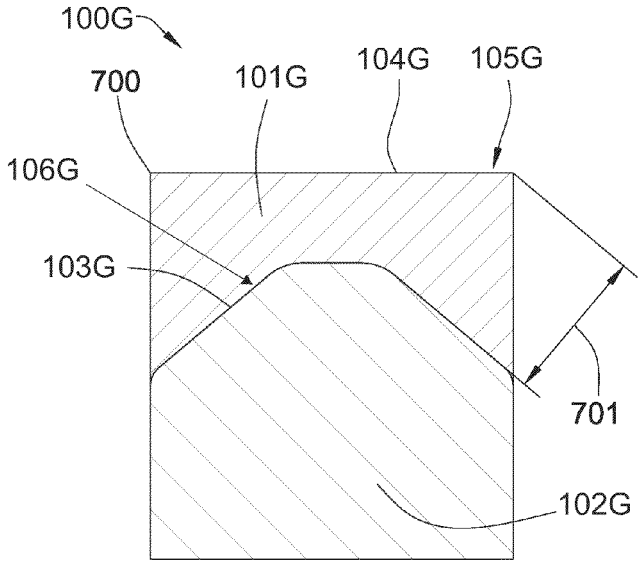
FIG. 7 is a cross-sectional diagram of another embodiment of a high impact resistant tool.

In the embodiment of FIG. 7, a high impact resistant tool 100G may have a flat working surface 104G. In this embodiment, a region 105G of high diamond/low catalyst density is located near a rim 700 on the working surface 104G. This embodiment may be useful in applications involving shearing where the formation exerts a force concentrated near the rim 700, such as a shear cutter. The region 105G may be located at least 0.100 to 0.500 inches away from a face 106G of the interface 103G, depending on a distance 701 from the interface 103G to the rim 700. The interface 103G may include a plurality of bumps, ridges, dimples, or other protrusions or recesses, which may improve the bond between a substrate 102G and a sintered body 101G.

Figure 8:
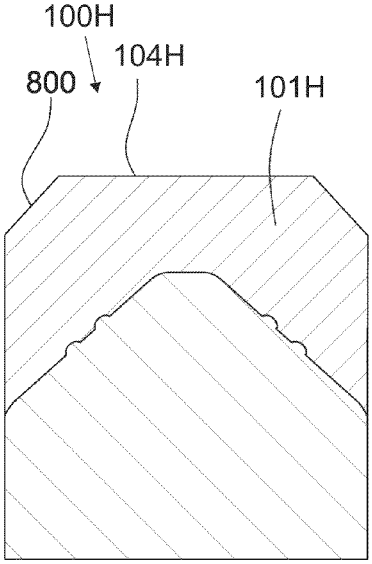
FIG. 8 is a cross-sectional diagram of another embodiment of a high impact resistant tool.

In the embodiment of FIG. 8, a high impact resistant tool 100H may have a sintered body 101H with a working surface 104H. Working surface 104H may have a chamfered rim 800.

Figure 9:
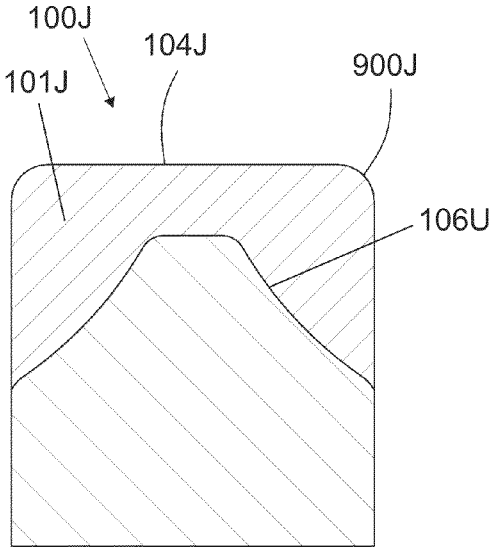
FIG. 9 is a cross-sectional diagram of another embodiment of a high impact resistant tool.
Figure 10:
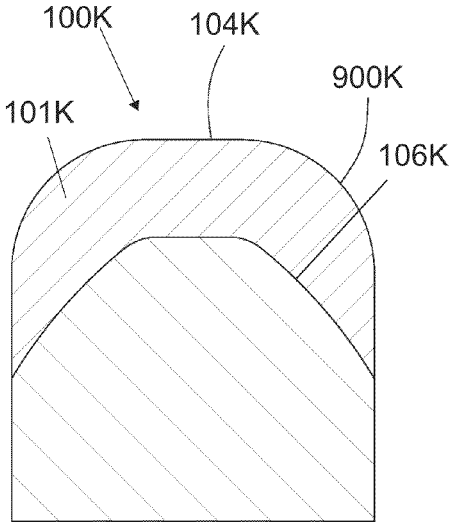
FIG. 10 is a cross-sectional diagram of another embodiment of a high impact resistant tool.

In the embodiments shown in FIGS. 9 and 10, a high impact resistant tool 100J, 100K may have a sintered body 101J, 101K with a working surface 104J, 104K. The working surface 104J 104K may have a rounded rim 900J, 900K with a radius. The radius may be from 0.25 to 0.400 inches. As shown in FIG. 9, a face 106J may be concave, or as shown in FIG. 10, a face 106K may be convex.

Figure 11:
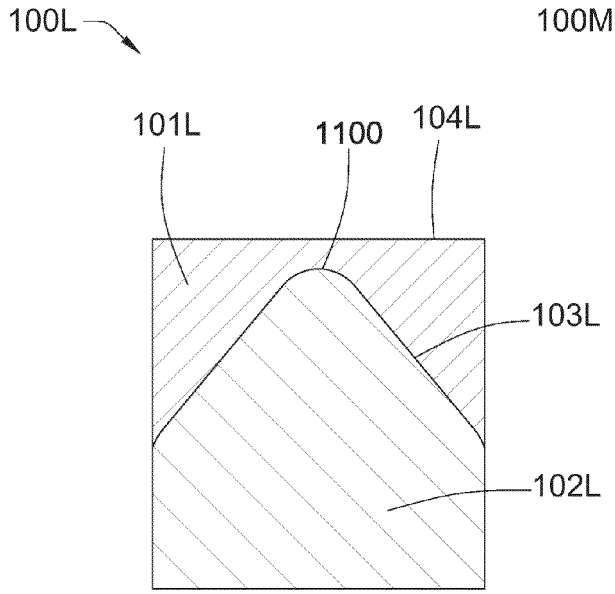
FIG. 11 is a cross-sectional diagram of another embodiment of a high impact resistant tool.

FIG. 11 shows an embodiment of a high impact resistant tool 100L having a nonplanar interface 103L. The nonplanar interface 103L may have a conical shape such that an apex 1100 of a substrate 102L is near a working surface 104L. The sintered body 101L may protect the apex 1100 of the nonplanar interface 103L from wear.

Figure 12:
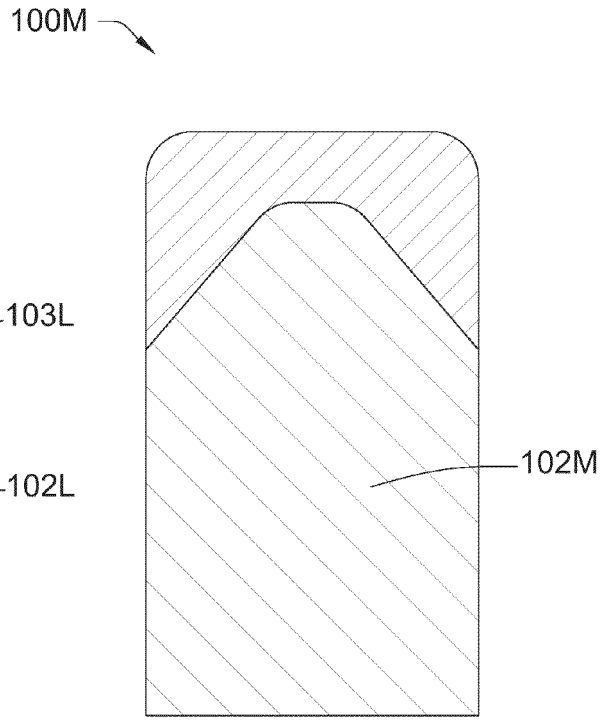
FIG. 12 is a cross-sectional diagram of another embodiment of a high impact resistant tool.

In the embodiment of FIG. 12, a high impact resistant tool 100M may have a large substrate 102M. In this embodiment, a volume of the substrate 102M may be from 0.010 to 0.500 cubic inches.

Figure 13:
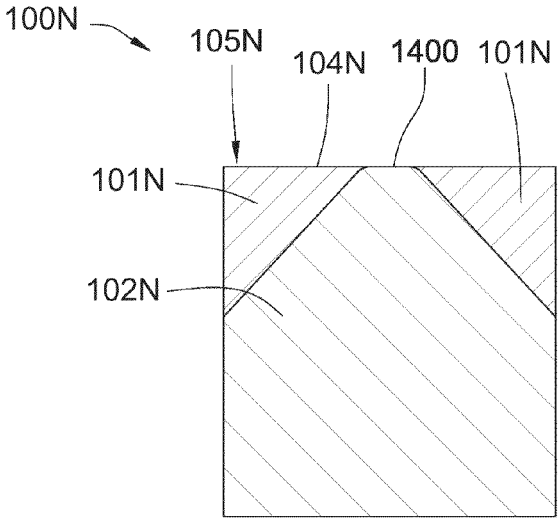
FIG. 13 is a cross-sectional diagram of another embodiment of a high impact resistant tool.

As shown in the embodiment of FIG. 13, a high impact resistant tool 100N may have an exposed portion 1400 of a substrate 102N near a working surface 104N. A sintered body 101N may have a plurality of high density superhard regions 105N wherein the exposed portion 1400 is between the high density superhard regions 105N. The sintered body 101N may also be segmented.

Figure 14:
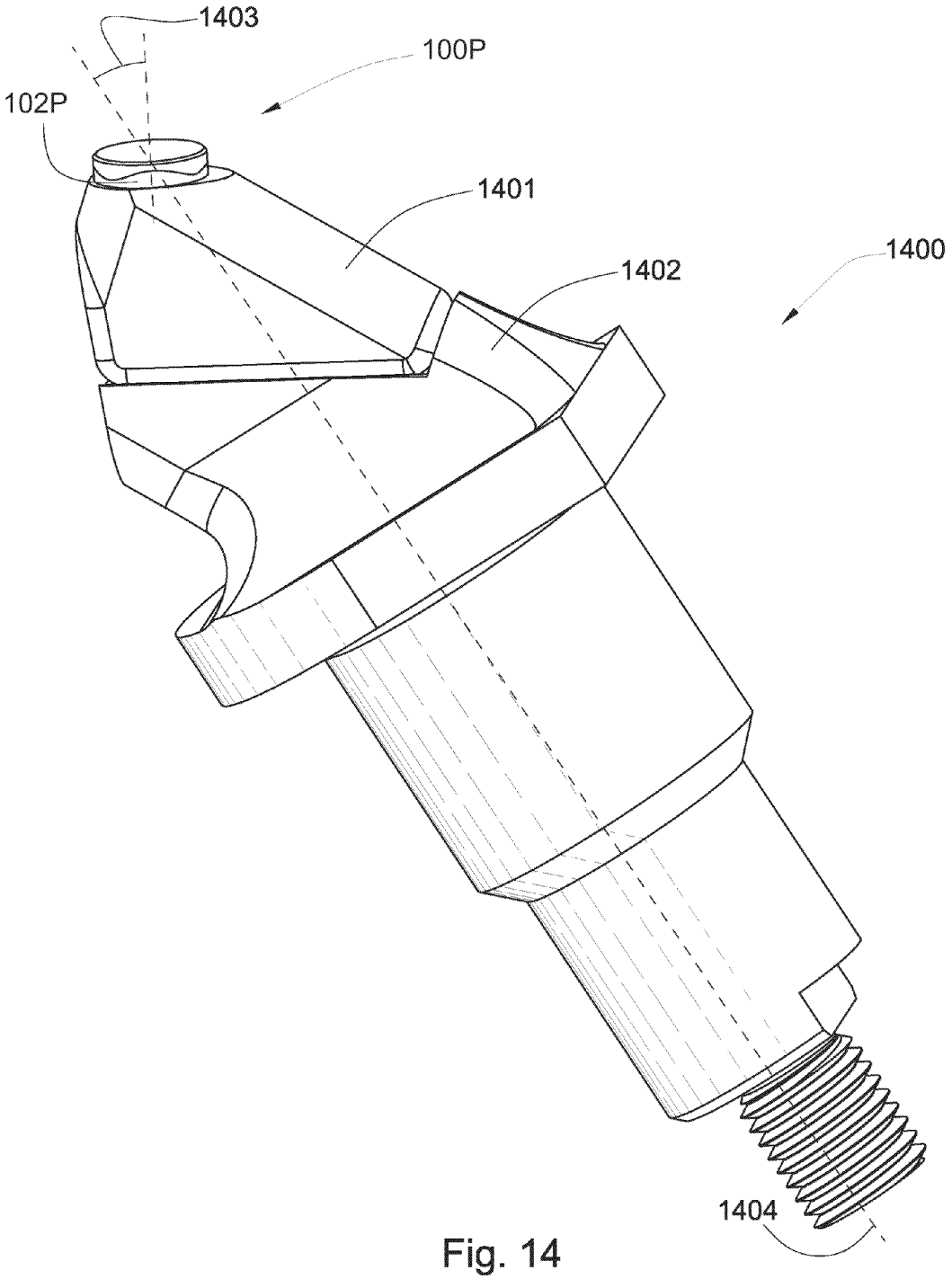
FIG. 14 is a perspective diagram of an embodiment of a high impact resistant tool.

Referring to FIG. 14, a high impact resistant tool 100P may be attached to an attack tool 1400 for use in the asphalt milling, trenching, or mining industries. The attack tool 1400 may have a plurality of segments 1401, 1402. The high impact resistant tool 100P may be bonded by brazing to a first segment 1401, typically made of a material similar to a carbide substrate 102P. The high impact resistant tool 100P may also be press fit into the first segment 1401. The first segment 1401 may be brazed or otherwise bonded to a second segment 1402, which may be typically made of a material softer than the first segment 1401, such as steel. The first segment 1401 may provide wear protection for the attack tool 1400. The high impact resistant tool 100P may be bonded to the first segment 1401 at an angle 1403 offset from a central axis 1404 of the attack tool 1400.

Figure 15:
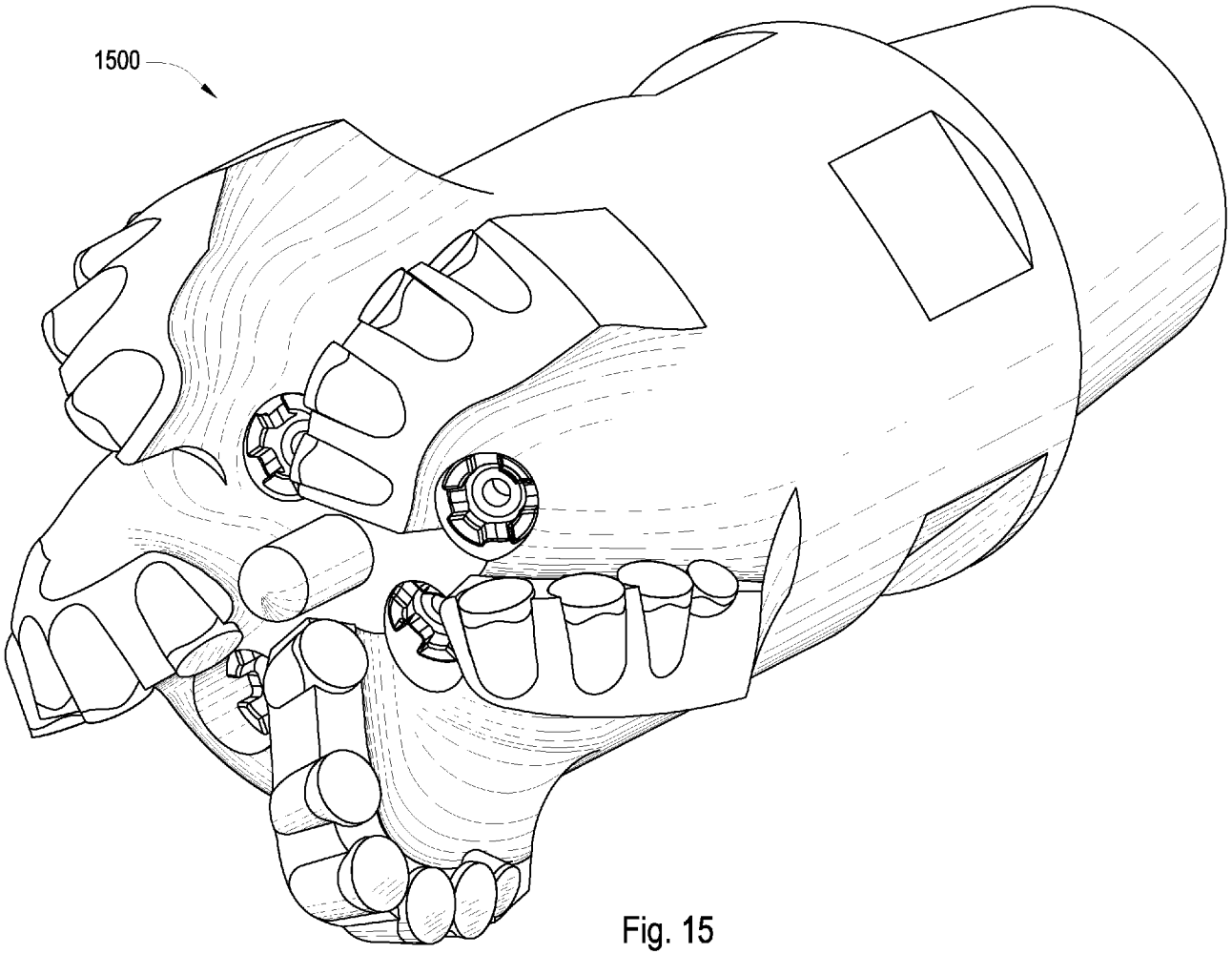
FIG. 15 is a perspective diagram of an embodiment of a drill bit.

Embodiments of the current invention may also be used in a drill bit in downhole drilling industries. The drill bit may be a shear bit 1500, as in the embodiment of FIG. 15. The current invention may also be used in a percussion bit, particularly in junk slots or gauge portions of the bit. The high impact resistant tool may also be adapted to be used in heat sinks, roller cone bits, mills, chisels, hammer mills, cone crushers, mulchers, jaw crushers, vertical shaft mills, bearings, indenters, valves, dies, wear parts, or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a body formed of sintered particles, said body having a central axis, a base surface, and a working surface with a rim spaced apart from said central axis; and a substrate having a base end and an interface surface spaced apart from said base end and abutting said base surface to form a non-planar interface, said interface surface having a plurality of adjacent faces arranged circumferentially about said central axis with an angle between said working surface and each face of said plurality of faces of 30 degrees to 60 degrees and a distance from said rim to each face of said plurality of faces from about 0.100 inch to about 0.500 inch;

where each face of said plurality of faces has a rounded junction between an adjacent face of said plurality of faces, said rounded junction having a radius of curvature from about 0.060 inch to about 0.140 inch.

2. The tool of claim 1, wherein the interface surface has at least 3 circumferentially adjacent faces.

3. The tool of claim 1, wherein the interface surface has an upper flatted portion normal to said central axis.

4. The tool of claim 3, wherein the interface surface has a rounded border between the flatted portion and each face, said rounded border having a radius of curvature from about 0.055 inch to about 0.085 inch.

5. The tool of claim 1, wherein said body has a varying metal concentration, wherein a first metal concentration proximate said non-planar interface is greater than a second metal concentration proximate said working surface.

6. The tool of claim 5, wherein said body further includes a third metal concentration, said third metal concentration proximate said rim, said third metal concentration being greater than said second metal concentration.

7. The tool of claim 1, wherein the substrate has a metal concentration from about 2 percent to about 10 percent metal by volume.

8. The tool of claim 1, wherein the substrate has a volume from about 0.010 cubic inches to about 0.500 cubic inches.

9. The tool of claim 1, wherein at least one face of said plurality of faces is concave.

10. The tool of claim 1, wherein at least one face of said plurality of faces is convex.

11. The tool of claim 1, wherein each face of said plurality of faces has an area, wherein said area is equal for each face.

12. The tool of claim 1, wherein said rim has a chamfered edge.

13. The tool of claim 1, wherein said rim has a rounded edge.

14. The tool of claim 13, wherein said rounded edge has a radius of curvature from about 0.25 inch to about 0.4 inch.

15. The tool of claim 1, wherein the body has a metal concentration of less than about 4 percent by volume.

16. The tool of claim 1, wherein the sintered particles are diamond particles.

17. A tool having high impact resistance, the tool comprising:

a substrate having
- a central axis,
- a base end, and
- a first interface surface, said first interface surface having a plurality of flat faces disposed circumferentially about said central axis;
- where each face has a planar geometry; and a body formed of sintered particles and a catalyst, said body having
- a working surface normal to said central axis,
- a second interface surface spaced apart from said working surface and disposed adjacent said first interface surface to form a non-planar interface, said second interface surface having a first region of sintered particles having a first catalyst concentration, and
- where the working surface has a rim about said central axis, said rim having a second region of sintered particles having a second catalyst concentration.

18. A high impact resistant tool, comprising:

a body formed of sintered particles, the body having a central axis, a base surface, and a working surface with a rim spaced apart from the central axis; and a substrate having a base end and an interface surface spaced apart from the base end and abutting the base surface to form a non-planar interface, the interface surface axis and intersecting with a periphery surface of the substrate, where each of the adjacent faces extend from the periphery surface of the substrate at an angle of 120 to 150 degrees.

19. The tool of claim 18, wherein each face of the plurality of faces has a rounded junction between an adjacent face of the plurality of faces.

20. The tool of claim 18, wherein at least one face of the plurality of faces has a planar geometry.

* * * * *